US007555255B2

(12) United States Patent
Onodera

(10) Patent No.: US 7,555,255 B2
(45) Date of Patent: Jun. 30, 2009

(54) IMAGE FORMING APPARATUS

(75) Inventor: Shinichi Onodera, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/021,449

(22) Filed: Jan. 29, 2008

(65) Prior Publication Data

US 2008/0131149 A1 Jun. 5, 2008

Related U.S. Application Data

(63) Continuation of application No. 11/470,475, filed on Sep. 6, 2006, now Pat. No. 7,356,301.

(30) Foreign Application Priority Data

Jun. 22, 2006 (JP) ..... 2006-172551

(51) Int. Cl.
*G03G 21/00* (2006.01)
*G03G 21/12* (2006.01)

(52) U.S. Cl. ..... 399/358; 399/360

(58) Field of Classification Search ..... 399/358, 399/360

See application file for complete search history.

(56) References Cited

U.S. PATENT DOCUMENTS 5,617,195 A 4/1997 Torimaru et al.
6,341,772 B1 1/2002 Waragai et al.
6,496,671 B2 12/2002 Nakajima
2004/0047651 A1 3/2004 Koyama et al.
2005/0220515 A1 10/2005 Wakana
2007/0031164 A1 2/2007 Ota

FOREIGN PATENT DOCUMENTS

JP 6-26928 A 2/1994
JP 2000-276021 A 10/2000

*Primary Examiner*—David M Gray
*Assistant Examiner*—Erika Villaluna
(74) *Attorney, Agent, or Firm*—Fitzpatrick, Cella, Harper & Scinto

(57) ABSTRACT

The image forming apparatus includes image forming device for forming a toner image on a recording material, a residual toner collecting container detachably provided on a main body of said image forming apparatus and adapted to collect residual toner discharged from said image forming means, said residual toner collecting container being capable of collecting the residual toner through an opening at a side of said container, and regulation means for preventing said containing container from being attached onto or removed from the main body of said image forming apparatus until the opening of said collecting container is directed upwardly in a gravitational direction and an inclined angle of said collecting container exceeds a set angle. It can prevent from flowing out through the opening more positively.

1 Claim, 7 Drawing Sheets

IMAGE FORMING APPARATUS

CROSS-REFERENCE TO RELATED APPLICATION

This application is a continuation of application Ser. No. 11/470,475, filed Sep. 6, 2006.

BACKGROUND OF THE INVENTION

1. Field of the Invention

The present invention relates to an image forming apparatus such as a copier, a printer and the like, and more particularly, it relates to an image forming apparatus capable of collecting residual toner discharged during image formation.

2. Description of the Related Art

In image forming apparatuses utilizing an electro-photographic technique or an electrostatic recording technique, after a toner image formed on an image gearing member such as a photosensitive drum is transferred to a paper (recording material), the toner image is fixed to the paper by fixing means such as thermal fixing means or pressure fixing means, thereby obtaining an image output.

In such an image forming apparatus, after the toner image is transferred to the paper, toner remaining on the image bearing member is removed from the image bearing member by a cleaning device and is then removed as residual toner. Then, the residual toner is conveyed, by residual toner conveying means, to a residual toner collecting container (residual toner bottle; hereinafter referred to as "bottle") removably provided on a main body of the image forming apparatus and then is discharged into the bottle through an opening provided in the bottle.

Further, an amount of the residual toner in the bottle is detected by full-bottle detecting means or full-bottle guessing means using counter means so that, when the amount of the residual toner in the bottle reaches a predetermined value, an exchanging time for the bottle is informed of, thereby exchanging the bottle to a new one.

By the way, the toner used in the electro-photographic image forming apparatus is characterized in that it has high fluidity and, thus, a top surface (powder surface) of the residual toner in the bottle tends to be shifted by vibration and/or inclination. Thus, upon exchanging the bottle, if the bottle is inclined, the residual toner is easily shifted.

On the other hand, when the bottle is shifted horizontally during the mounting and dismounting of the bottle with respect to the main body of the apparatus or when there is no adequate space in the apparatus above the bottle, a bottle into which the residual toner conveyed by the residual toner conveying means is received through a side opening is used.

However, when the bottle having the side opening is tried to be removed from the main body of the apparatus, the residual toner in the bottle may be shifted by the inclination of the bottle or the like to flow out through the side opening with the result that the interior or neighborhood of the apparatus may be contaminated by the discharged residual toner.

Japanese Patent Application Laid-open No. 2000-276021 and Japanese Utility Model Publication No. 06-26928 (1994) disclose a technique which can prevent toner from flowing out of an opening by orienting the opening of a residual toner collecting container toward an upward direction when the container is removed from a main body of an apparatus.

In the Japanese Patent Application Laid-open No. 2000-276021, as shown in FIG. 12, projections 501 and 502 provided on a residual toner bottle 500 are guided by slits 521 and 522 formed in a support plate 520. When the residual toner bottle is drawn out horizontally in the direction of arrow *Z*2 from the main body of the apparatus 170, the guiding of the projection 501 is released to achieve a free condition, and, the lower projection 502 abuts an edge 522*c*1 of the lower slit 522, thereby regulating the guiding movement toward the drawing-out direction. Thus, the bottle can be rotated around the projection so as to direct an opening 503 of the residual toner bottle toward the upward direction.

However, in the arrangement disclosed in the Japanese Patent Application Laid-open No. 2000-276021, since the bottle can be drawn out in the free condition of the projection 501, the operator may draw out or remove the bottle in a condition that the opening of the residual toner bottle is not completely directed toward the upward direction. Thus, there is a danger of flowing out the toner through the opening of the residual toner bottle.

SUMMARY OF THE INVENTION

An object of the present invention is to provide a residual toner collecting container having a side opening for collecting residual toner, in which, when the residual toner collecting container is removed from a main body of an apparatus, the toner can be prevented from flowing out through the opening more positively.

Another object of the present invention is to provide an image forming apparatus comprising image forming means for forming a toner image on a recording material, a residual toner collecting container capable of being removably mounted to a main body of the image forming apparatus and adapted to collect residual toner discharged from the image forming means through a side opening, and regulation means for preventing the mounting and dismounting of the residual toner collecting container with respect to the main body of the apparatus until an inclined angle of the residual toner collecting container from a vertical upward position of the opening reaches a set angle.

A further object of the present invention will become apparent from the following description of exemplary embodiments with reference to the attached drawings.

DESCRIPTION OF THE EMBODIMENTS

First Embodiment (1) Image Forming Portion

Figure 2:
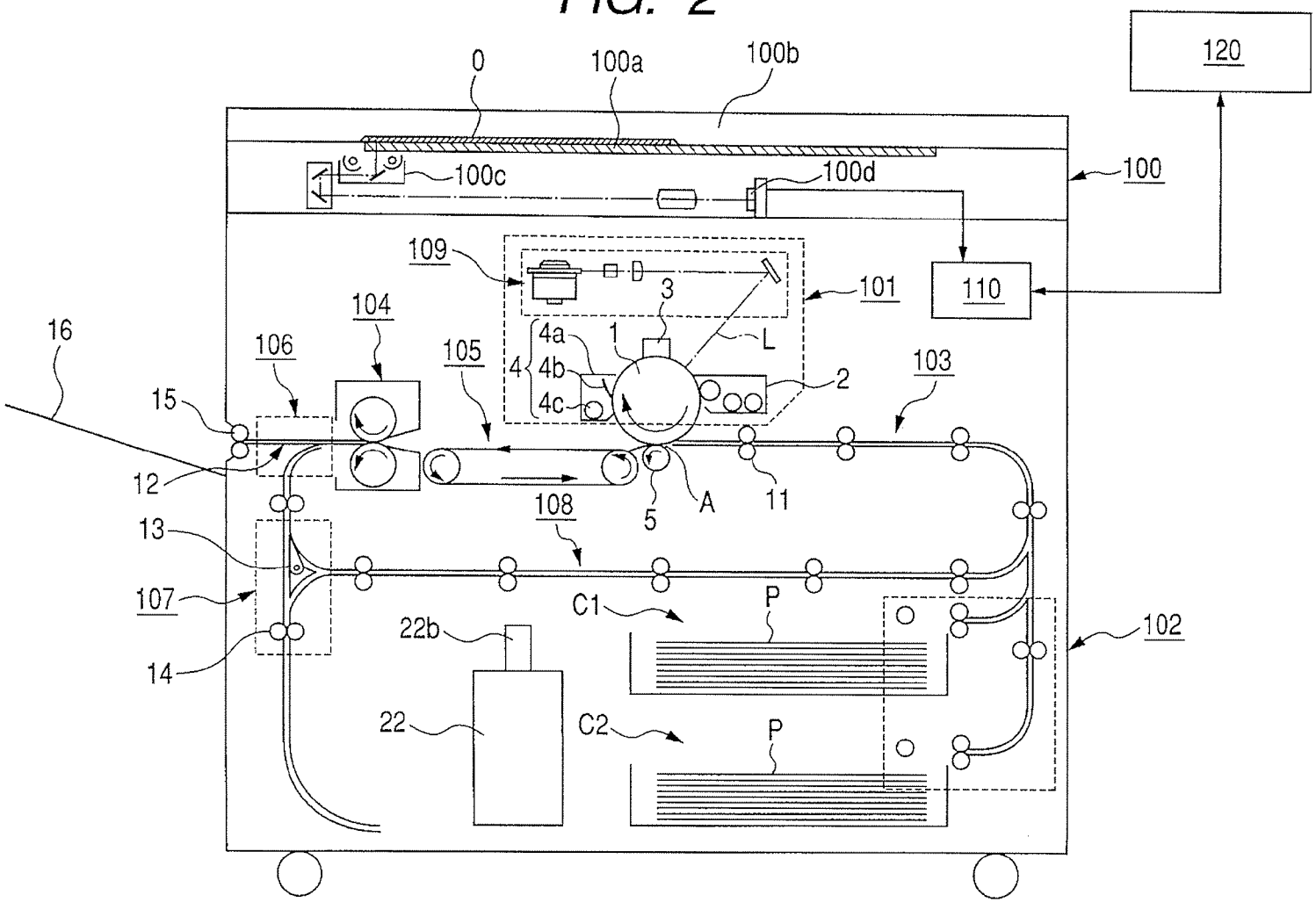
FIG. 2 is a schematic view of an image forming apparatus.

FIG. 2 is a schematic longitudinal sectional view showing schematic internal mechanisms of an image forming apparatus according to a first embodiment of the present invention. The image forming apparatus described herein is an electrophotographic digital composite machine having a copier function, a printer function and a facsimile function.

The image forming apparatus includes an image reading portion 100 in which an original O is rested on an original glass plate 100*a* in accordance with a placement reference, with facing an imaged surface thereof toward a downward direction, and then, an original pushing plate 100*b* is closed. When a copy key is pressed, a movable optical system 100*c* is shifted to optically scan the imaged surface of the original. As a result, image information of the imaged surface is read photo-electrically by an imaging device (CCD) 100*d* as an electrical image signal. The image signal is inputted to an image processing portion (controller) 110 for producing an image forming signal, where the image signal is processed. An automatic original feeding device may be provided in association with the original glass plate 100*a* so as to feed the original onto the original glass plate 100*a* automatically.

The apparatus also includes an image forming portion 101 which is electro-photographic process equipment using a laser exposure device 109 as exposure means. The image forming portion includes a drum type of electro-photographic photosensitive member (hereinafter referred to as "drum" hereinafter) 1 as an image bearing member which is rotatingly driven in a clockwise direction shown by the arrow at a predetermined speed. A peripheral surface of the rotating drum 1 is uniformly charged by a primary charging device 3 with predetermined polarity and potential. By using the laser exposure device 109, the charged surface of the drum is subjected to scan exposure L. The laser exposure device 109 serves to perform scan/exposure of the drum surface by using a laser beam modulated in correspondence to the image forming signal produced in the image processing portion 110. As a result, an electrostatic latent image corresponding to the original image information read and processed in the image reading portion 100 is formed on the surface of the drum 1. Then, the electrostatic latent image is developed as a toner image by a developing device 2. At a transferring point (transferring nip) A which is a contact area between the drum 1 and a transferring roller 5, the toner image is transferred onto a recording material (referred to as "paper" hereinafter) P fed from a paper feeding portion 102 to the transferring point A.

After the paper P is passed through the transferring point A, the paper is separated from the surface of the drum 1 and is directed, by a fixing conveying portion 105, to a fixing device 104, where the toner image is subjected to a fixing process.

Further, after the paper is separated, the drum surface 1 is cleaned by a cleaning device 4 to remove transfer residual toner, thereby preparing for next image formation. The residual toner removed by the cleaning device 4 is discharged from the cleaning device and then is conveyed by a residual toner conveying device (residual toner conveying means) into a residual toner collecting container (residual toner bottle) 22 provided separately from the cleaning device 4 and is stored in the bottle. This will be fully described in the following item (2).

In the paper feeding portion 102, the papers P from a first or second paper cassette C1 or C2 are separated one by one and the separated paper is fed. The separated paper P is introduced into the transferring point A through a transfer conveying portion 103 including a pair of registration rollers 11. The pair of registration rollers 11 serves to convey the paper P to the transferring point A in a timed relation to initiation of formation of the toner image on the drum 1.

The paper P discharged from the fixing device 104 passes through a horizontal passage of a paper discharge processing portion 106 and is discharged onto a paper discharge tray 16 by means of a pair of paper discharge rollers 15.

In case of a both surface image forming mode or a multi image forming mode, after discharged from the fixing device 104, the paper P having a first surface on which the image was formed or subjected to the first image formation is introduced into a both surface/multi processing portion 107 by a first path changing device (flag) 12 of the paper discharge processing portion 106. On the other hand, in case of the both surface image forming mode, the paper P is temporarily introduced into a reverse rotation conveying portion including a pair of reverse rotation rollers 14 by means of a second path switching device (flag) 13. Then, the paper is switched-back to turn the paper over from the front surface to the rear surface and then is introduced into a both surface multi conveying portion 108 and then is fed to the transferring point A again. In this way, the paper on both surfaces of which the images were formed is discharged onto a paper discharge tray 16. Further, in case of a multi image formation mode, a paper P introduced into a both surface multi processing portion 107 is introduced into the both surface multi conveying portion 108 without being turned over and then is fed to the transferring point A again. In this way, the paper on which a multiple of images were formed is discharged onto the paper discharge tray 16.

The above-mentioned explanation relates to a copier mode. In case of a printer mode, an image signal is inputted to the image processing portion 110 from an external host device 120 including a personal computer, an image reader and the like. The image processing portion 110 produces an image forming signal on the basis of the image signal and outputs the image forming signal to the laser exposure device 109 and causes the image forming apparatus to operate as a printer. On the other hand, in case of a facsimile receiving mode, an image signal from an opponent facsimile device 120 as an external device is inputted to the image processing portion 110. The image processing portion 110 produces an image forming signal on the basis of the image signal and outputs the image forming signal to the laser exposure device 109 and causes the image forming apparatus to operate as a facsimile receiving device. In case of a facsimile sending mode, the image processing portion 110 sends original image information photo-electrically read by the image reading portion 100 to the opponent facsimile receiving device 120.

(2) Cleaning Device 4 and Residual Toner Collecting Container 22

As mentioned above, after the toner image is transferred to the paper P at the transferring point A, non-transferred toner remaining on the drum 1 is collected by the cleaning device 4 as residual toner, and, the residual toner is conveyed into the residual toner collecting container 22 by a residual toner conveying device.

Hereinafter, the main body of the image forming apparatus is referred to as "apparatus body". A term "longitudinal (direction)" means a direction parallel to a rotation axis of the drum 1. Incidentally, in this specification, a side in a design of the image forming apparatus where the operator is to be normally positioned when he/she utilizes the image forming apparatus is defined as "front". A term "front side" or "front" means a front side or front when the operator looks at the image forming apparatus from a front side, and a term "rear side" or "rear" means a rear side or rear when the operator looks at the image forming apparatus from a front side. Further, terms "left" and "right" mean left and right when the operator looks at the image forming apparatus from a front side.

Figure 1:
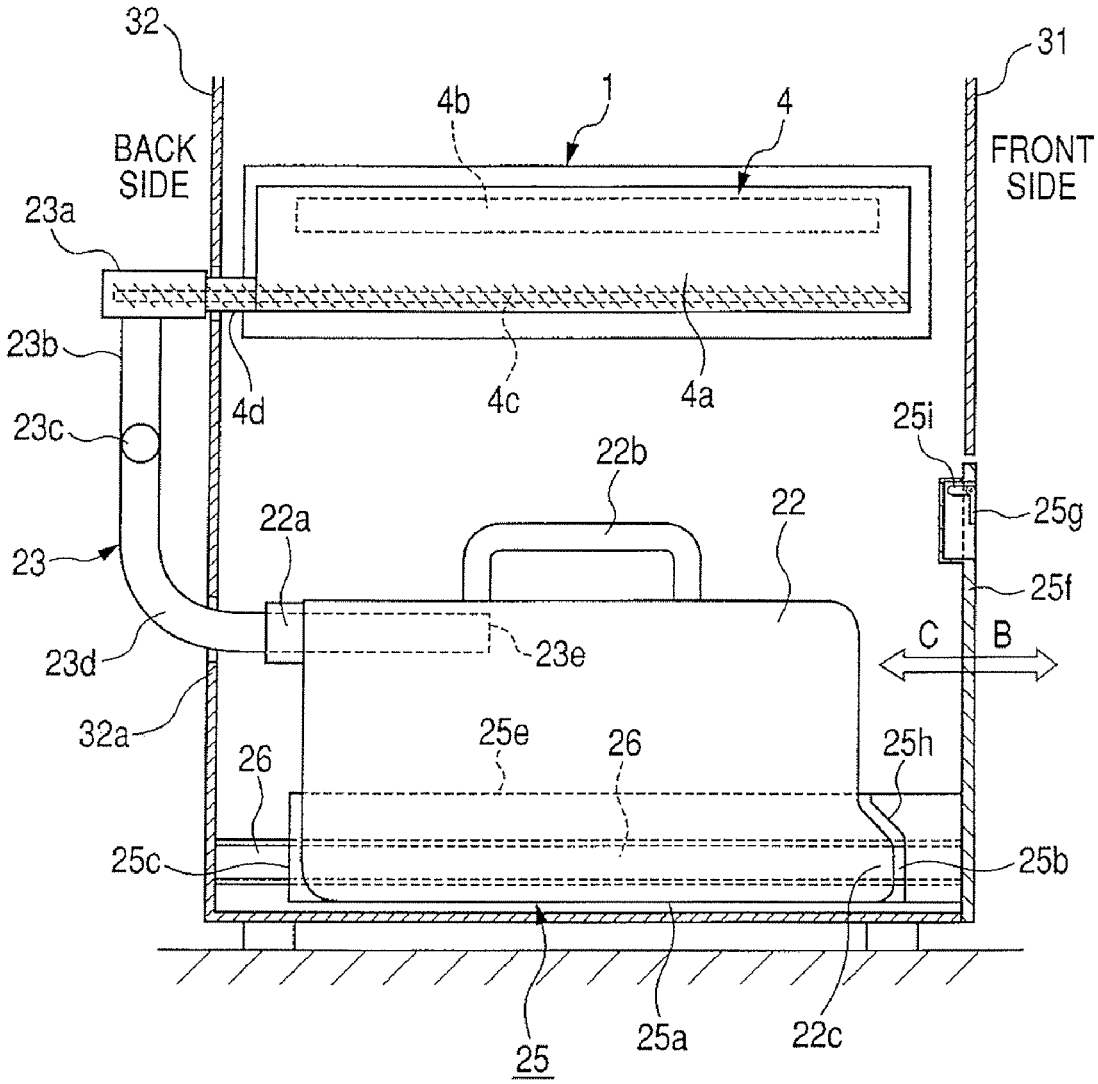
FIG. 1 is a schematic view showing a residual toner collecting portion according to a first embodiment of the present invention.
Figure 3:
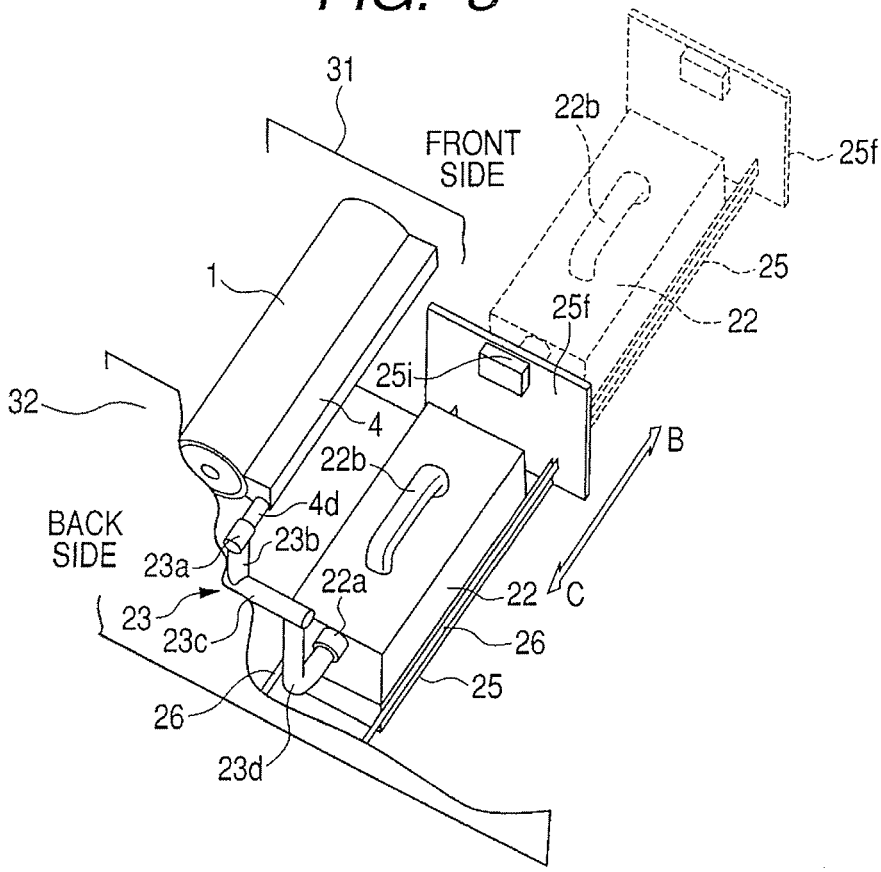
FIG. 3 is a perspective view of the residual toner collecting portion.

As shown in FIGS. 1 and 3, the drum 1 is positioned between front and rear plates 31 and 32 of a main frame of the apparatus in such a condition that the rotation axis of the drum extends in a front-rear direction. The cleaning device 4 is of blade type and comprises a cleaning container 4*a*, and a cleaning blade 4*b* and a toner conveying screw shaft 4*c* which are provided along a longitudinal direction of the cleaning container within the cleaning container. The blade 4*b* is an elastic blade having an edge portion which abuts against the surface of the rotating drum 1 in a counter direction. By this blade, the surface of the drum 1 is cleaned during the rotation of the drum, so that the non-transferred toner on the drum surface is scraped into the container 4*a*. The scraped toner is conveyed toward the longitudinal rear side within the container 4*a* by the screw shaft 4*c* and then is discharged through a toner discharge port 4*d*. The discharged toner is conveyed to the residual toner collecting container (hereinafter referred to as "bottle") 22 located at a lower portion within the apparatus body by a residual toner conveying device 23.

The residual toner conveying device 23 is communicated with the toner discharge port 4*d* positioned at a longitudinal rear side end portion of the cleaning container 4*a* via a connection portion 23*a*. The residual toner conveying device 23 comprises a first downwardly oriented pipe portion 23*b* communicated with the connection portion 23*a*, a second lateral pipe portion 23*c* communicated with the first pipe portion, and a third pipe portion 23*d* communicated with the second pipe portion. The third pipe portion 23*d* includes a downwardly directed pipe portion communicated with the second pipe portion 23*c* and a horizontal pipe portion bent forwardly and extending from the downwardly directed pipe portion toward the front side. The first pipe portion 23*b*, second lateral pipe portion 23*c* communicated with the first pipe portion and third pipe portion 23*d* communicated with the second pipe portion constitute a conveying path for conveying the residual toner discharged from the toner discharge port 4*d* into the residual toner collecting container. The connection portion 23*a*, the first pipe portion 23*b*, the second pipe portion 23*c* and the downwardly directed pipe portion of the third pipe portion 23*d* of the residual toner conveying device 23 are positioned outside the rear plate 32. The horizontal pipe portion of the third pipe portion 23*d* is inserted into the interior of the apparatus body through a hole 32*a* formed in the rear plate 32 in a direction parallel to the rotation axis of the drum 1. That is, the horizontal pipe portion of the third pipe portion 23*d* is protruded (inserted) into the interior of the bottle through an opening (side opening of the container) 22*a* formed in a rear upper side portion of the bottle 22. In this condition, a toner discharge port 23*e* as a leading end opening portion of the third pipe portion 23*d* is positioned, within an upper part of the interior of the bottle, substantially at a middle point of the longitudinal length of the bottle. A handle (grip) 22*b* is provided at a longitudinal central portion of an upper surface of the bottle 22. In the illustrated embodiment, while an arrangement in which the side opening 22*a* is formed in the rear side surface of the bottle was described, the present invention is not limited to such an example, but such an opening may be provided at left or right front side surface.

In the cleaning device 4, the residual toner conveyed, within the container 4*a*, toward the longitudinal rear side by the rotation of the screw shaft 4*c* is discharged into the first pipe portion 23*b* of the residual toner conveying device 23 through the toner discharge port 4*d* and then enters into the second pipe portion 23*c*. The toner entered into the second pipe portion 23*c* is conveyed through the second and third pipe portions 23*c* and 23*d* by a rotation of a flexible coil screw (not shown) as toner conveying means provided within the second and third pipe portions 23*c* and 23*d*. Then, the toner is discharged into the bottle 22 through the toner discharge port 23*e* as the leading end opening portion of the third pipe portion 23*d* and is stored in the bottle.

An amount of the residual toner in the bottle 22 is detected by full-bottle detecting means (not shown) or full-bottle guessing means using counter means of the image processing portion 110. When the amount of the residual toner stored in the bottle reaches a predetermined value, an exchanging time for the bottle 22 is informed of on a display (not shown) of the apparatus body, thereby exchanging the bottle 22 to a new one.

Figure 4:
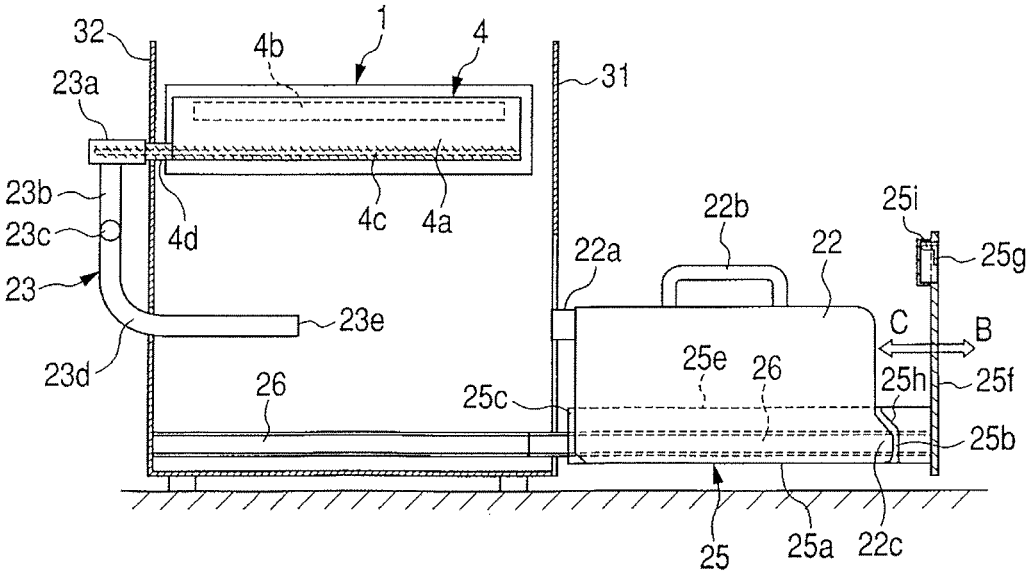
FIG. 4 is a view showing a condition that a holding tray by which the residual toner collecting container is held is drawn.
Figure 5:
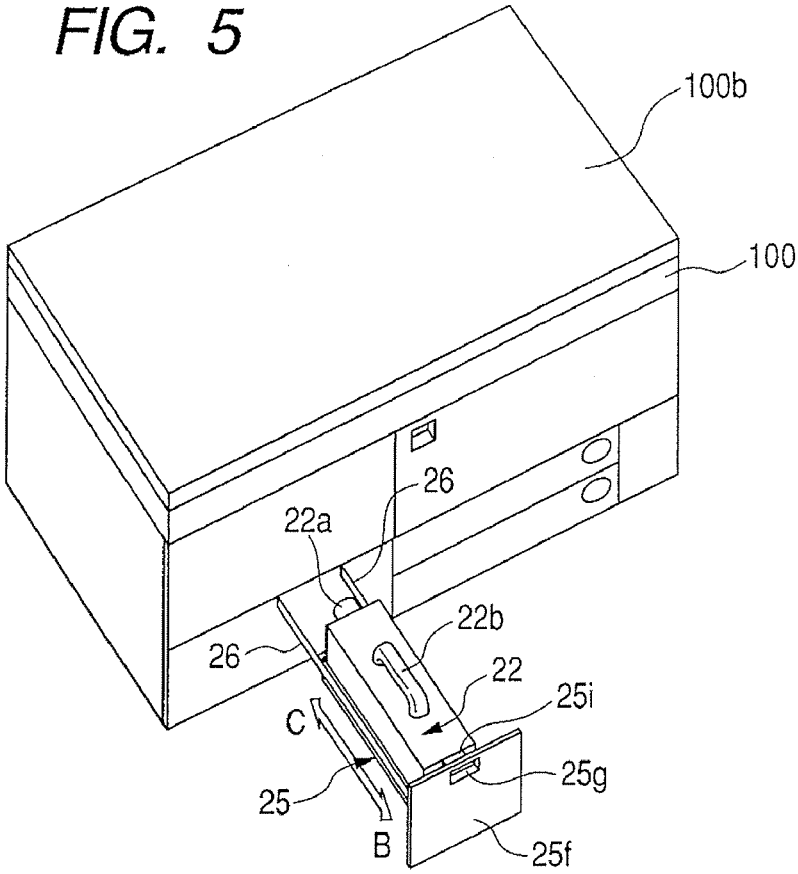
FIG. 5 is a perspective view showing the condition that the holding tray by which the residual toner collecting container is held is drawn.

Next, the exchanging of the bottle will be explained. In the illustrated embodiment, a retractable holding tray 25 which can be inserted in and retracted from the apparatus body from the front side of the apparatus body is provided with respect to the apparatus body, and the bottle 22 is rested on the tray 25. The tray 25 can be slidably shifted toward a front side direction B and a rear side direction C of the apparatus body along a slide rail (for example, Accuride® rail) 26. When the tray 25 on which the bottle 22 is held is completely inserted into the apparatus body, as shown in FIGS. 1 and 3, the bottle 22 can be installed at a predetermined residual toner collecting position within the apparatus body. Further, when the tray 25 is completely drawn out toward the front side direction B, as shown in FIGS. 4 and 5, the entire bottle 2 can be with drawn out and exposed out of the front side of the apparatus body.

Figure 6:
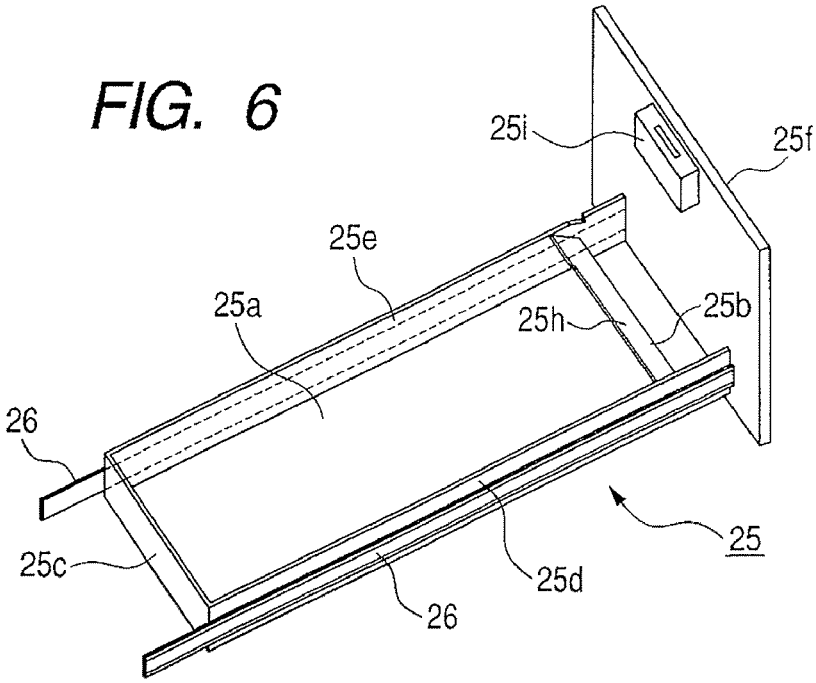
FIG. 6 is a perspective view of the holding tray.

FIG. 6 is a perspective view of the holding tray 25. The tray 25 includes a bottom plate 25*a* on which the bottle 22 is rested, front wall, rear wall, left wall and right wall plates 25*b*, 25*c*, 25*d* and 25*e* which can prevent the bottle 22 on the bottom plate 25*a* from shifting toward front, rear, left and right directions, and a front side plate 25*f* fixed to a front end of the bottom plate 25*a* in perpendicular to the bottom plate. Inner rails of the slide rail 26 are secured to outer surfaces of the left wall plate 25*d* and the right wall plate 25*e* along a longitudinal direction, respectively. In correspondence to the inner rails of the tray 25, left and right outer rails are secured to the apparatus body along a front-rear direction. By fitting the left and right inner rails of the tray 25 into the left and right outer rails of the apparatus body, the tray 25 is mounted to the apparatus body so that the tray can be slid in the front direction B and the rear direction C.

When the tray 25 is completely pushed into the apparatus body, a further pushing movement of the tray is prevented by a stopper (not shown), with the result that the front side plate 25*f* becomes flush with a front side plate 31 of the apparatus body and a returning movement of the tray is prevented by a locking mechanism 25*i*. In order to pull or draw out the tray 25, the front side plate 25*f* is drawn out by pulling a lock releasing lever/swinging finger grip 25*g* provided on the front side plate 25*f* of the tray 25. As a result, the locking mechanism 25*i* is released, so that the tray can be drawn out of the front side of the apparatus body. When the tray 25 is completely drawn out, the dislodging of the slide rail 26 is prevented by a stopper (not shown), thereby preventing a further drawing-out movement of the tray 25.

After the tray 25 is completely drawn out, the bottle 22 is installed on the bottom plate 25*a* encircled by the front, rear, left and right wall plates in such a manner that the longitudinal direction of the bottle coincides with the longitudinal direction of the bottom plate 25*a* and an opening 22*a* of the bottle is directed toward the rear side. In this condition, when the tray 25 is inserted into the apparatus body, in the course of the movement of the tray, the opening 22*a* of the bottle 22 is opposed to the toner discharge port 23*e* of the third pipe portion 23*d*, and, as the tray 25 continues to move, the horizontal pipe portion of the third pipe portion 23*d* enters into the bottle 22. When the tray 25 is completely inserted, as shown in FIGS. 1 and 3, the bottle 22 is positioned at a predetermined residual toner collecting position within the apparatus body.

In order to exchange the bottle 22 fully filled with the residual toner, the tray 25 is drawn out. In the course of the drawing-out movement of the tray, the horizontal pipe portion of the third pipe portion 23*d* comes out from the bottle 22. When the tray 25 is completely drawn out, as shown in FIGS. 4 and 5, the bottle 22 fully filled with the residual toner can be drawn out of the front side of the apparatus body to be an exposed condition. Thus, the operator can remove the bottle 22 from the tray 25 by lifting the bottle via the grip 22*b*. Then, a new bottle (vacant bottle) 22 is rested on the tray 22 and the tray 25 is completely inserted into the apparatus body. In this way, the exchanging from the old bottle 22 to the new bottle is completed.

In the illustrated embodiment, a protruded portion 22*c* is provided on a lower part of the front side of the bottle 22 opposite to the rear side thereof in which the opening 22*a* is provided. Further, an interference portion 25*h* is provided on the front wall plate 25*a* of the tray 25 so that, when the bottle 22 rested on the tray 25 is lifted upwardly, the interference portion can interfere with the protruded portion 22*c* of the bottle 22.

Figure 7:
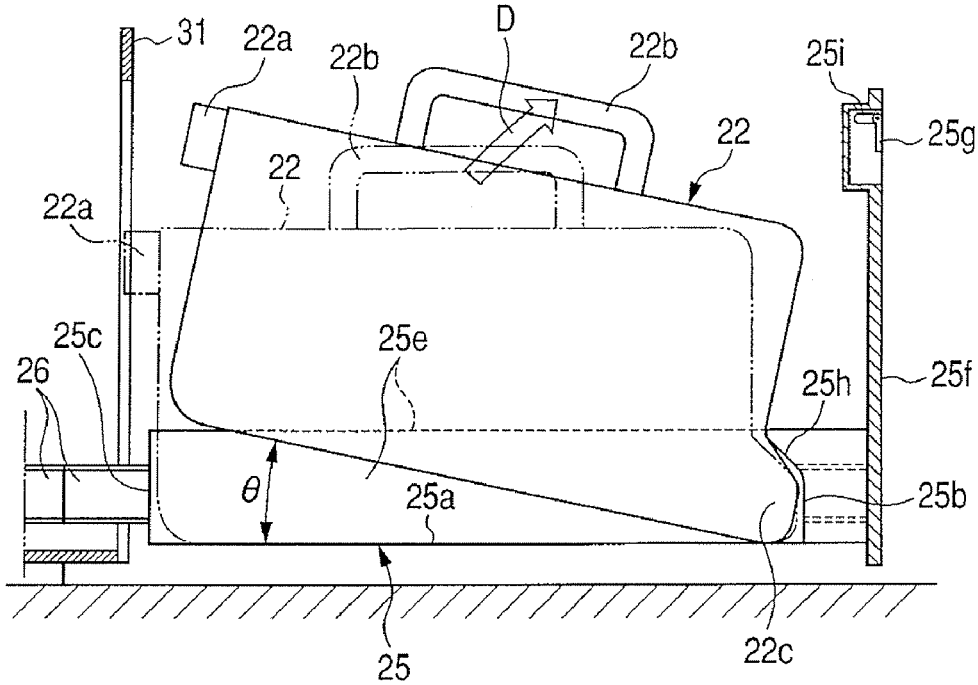
FIG. 7 is a view showing a condition that the residual toner container is lifted obliquely.

Thus, in a case where the bottle 22 fully filled with the residual toner is exchanged, after the tray 25 is completely drawn out to expose the bottle 22 out of the apparatus body, when the bottle is lifted upwardly via the grip 22*b* on the bottle, the protruded portion 22*c* is caught by the interference portion 25*h*, thereby preventing the upward movement of the bottle. Thus, as shown in FIG. 7, the bottle 22 takes a posture in which the bottle side having the opening 22*a* is inclined upwardly. Incidentally, the arrow D shows a direction along which the bottle 22 is lifted in the inclined condition.

The interference portion 25*h* cooperates with the protruded portion 22*c* in such a manner that, only after an inclined angle of the bottle 22 exceeds a predetermined set angle θ, the bottle 22 can be removed or dismounted, and thus, the interference portion acts as regulation means for preventing the side opposite to the side having the opening 22*a* from shifting upwardly.

In this way, the residual toner fully filling the bottle can be prevented from shifting toward the opening 22 and flowing out through the opening 22*a* due to the above-mentioned inclination of the bottle 22 during the lifting of the bottle 22 from the tray 25. That is to say, the toner scattering during the exchanging of the bottle can be prevented.

Figure 8:
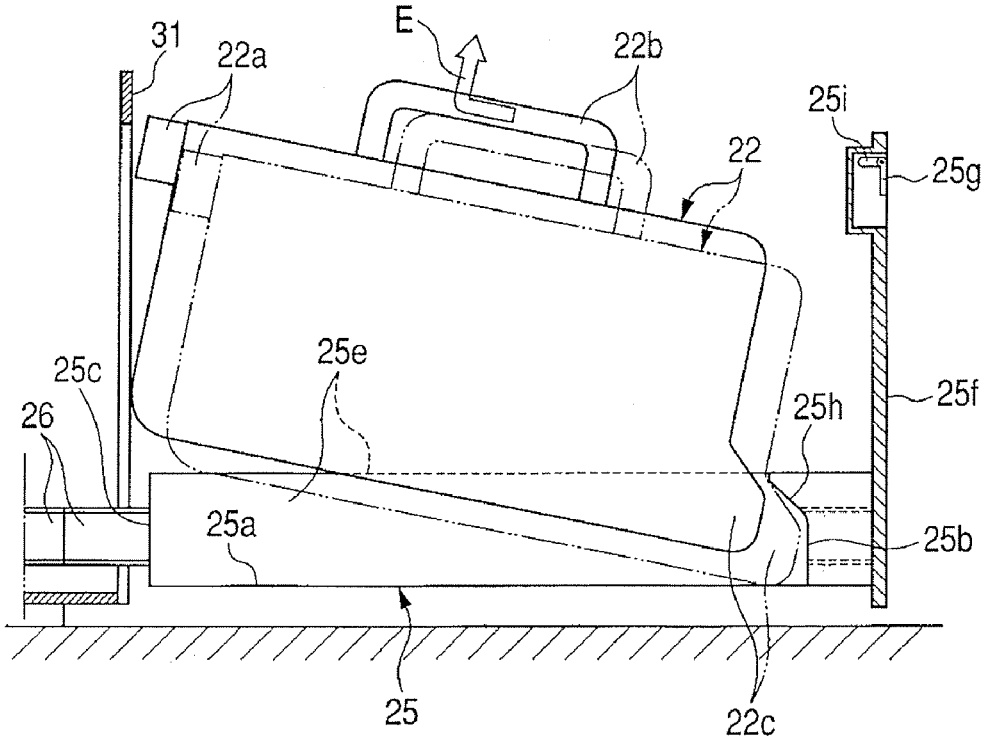
FIG. 8 is a view showing a condition that the residual toner container is lifted obliquely.

In the next operation, as shown in FIG. 8, the bottle 22 so lifted obliquely, as shown by an arrow E, is further lifted while shifting the bottle toward the rear side of the tray 25 to disengage the protruded portion 22*c* from the interference portion 25*h*, thereby removing the bottle from the tray 25.

Then, when the new bottle (vacant bottle) is installed on the tray 25, the above-mentioned operations may be reversed.

Figure 9:
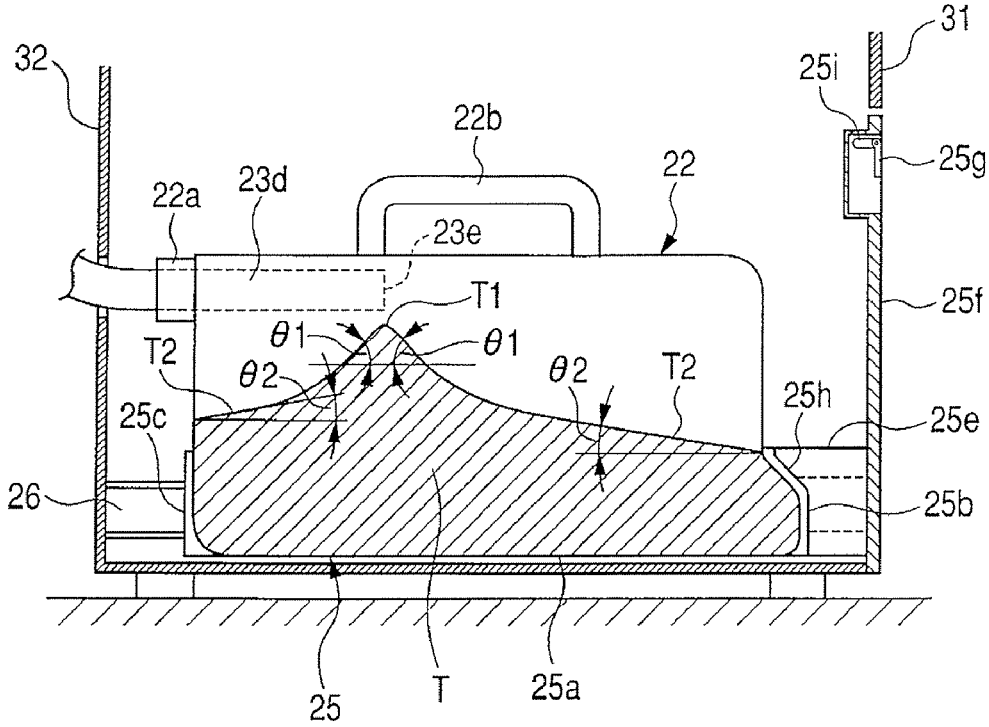
FIG. 9 is a model view showing a condition that the residual toner is accumulated.

FIG. 9 shows a modeled accumulated condition of the residual toner within the bottle. Here, it is assumed that a rest angle as an inclined angle of a slope when the residual toner T as powder is statically dropped and accumulated is θ1 and a collapse angle as an inclined angle of the slope broken by vibration during the operation of the apparatus and/or during the sliding movement of the tray 25 is θ2. It can be regarded that the inclined angle of the slope in the vicinity of an apex T1 onto which the residual toner from the toner discharge port 23*e* of the residual toner conveying device 23 is dropped and accumulated is θ1 and the inclined angles of the slopes in the vicinity of the skirts T2 is θ2.

In the illustrated embodiment, by the inclination of the bottle 22 as shown in FIG. 7 when the bottle 22 is lifted from the tray 25, a minimum inclined angle θ of the bottle 22 required when the lower part of the rear side of the bottle 22 is passed over the rear wall plate 25*c* of the tray to float the bottle from the bottom plate 25*a* of the tray is set to be greater than an angle value obtained by subtracting the collapse angle from the rest angle. That is to say, the minimum inclined angle is set to satisfy the following relationship:

$$\theta > \theta 1 - \theta 2 \quad (1)$$

Accordingly, when the bottle 22 is lifted from the tray 25, if the inclined angle θ of the bottle 22 reaches an angle satisfying the above relationship, in the vicinity of the apex T1 of the residual toner T accumulated in the bottle 22, the inclined angle of the slope at the side which the opening 22*a* exists becomes smaller than the collapse angle θ2 of the residual toner T. Thus, the accumulated residual toner T is not broken toward the opening 22*a*. That is to say, when the bottle 22 is lifted via the grip 22*b*, the bottle 22 is inclined so that the opening 22*a* of the bottle is directed upwardly, and, by such inclination of the bottle 22, the residual toner is shifted in the bottle, with the result that the gravity center of the bottle is shifted toward a direction where the opening is hard to be inclined downwardly. As a result, the residual toner fully filled in the bottle can be prevented from shifting toward the opening 22*a* and thus from flowing out of the opening 22*a*, thereby preventing the toner scattering during the exchange of the bottle.

As mentioned above, in the image forming apparatus according to the illustrated embodiment, since the side of the bottle 22 opposite to the opening 22*a* is prevented from being shifted upwardly, during the mounting and dismounting of the bottle, the side of the bottle having the opening is inclined upwardly. Thus, the residual toner in the bottle can be prevented from being shifted toward the opening and thus from flowing out of the opening. In particular, since the inclined angle θ required when the bottle 22 is mounted and dismounted with respect to the holding tray 25 is set to satisfy the above-mentioned relationship (1), the residual toner accumulated in the bottle can positively be prevented from breaking toward the opening. Further, since the collapse angle θ2 of the residual toner T is greatly influenced by the disturbance condition such as vibration, in the illustrated embodiment, the collapse angle θ2 is defined or set on the basis of conditions including the vibration caused during the sliding movement of the holding tray 25. However, in an image forming apparatus in which the sliding movement of the bottle is not performed during the exchange of the bottle, the collapse angle θ2 may be defined only on the basis of the vibration condition caused by the operation of the apparatus. In the present invention, the rest angle of the residual toner was sought as follows. That is to say, the rest angle was sought on the basis of a rest angle measuring method described in a handling manual attached to a Powder Tester-PT-N Type (manufactured by Hosokawa Micron Co. Ltd) as a measuring device. Namely, the rest angle was sought under conditions of screen mesh=710 μm, vibration time=180 sec and amplitude=2 mm or less.

However, after a sample was left as it is under a condition of 23° C. and 60% RH overnight, the rest angle of the sample was measured by a measuring device under the condition 23° C. and 60% RH. The measurements were repeated by 5 times and the results were averaged to obtain the rest angle value. Further, the collapse angle was sought as follows. That is to say, in a condition that the residual toner is loaded in the bottle fully or substantially fully (condition for the bottle exchanging), the bottle was slid to remove the bottle from the apparatus body. In this case, an inclination angle (θ2 in FIG. 9) of toner accumulation from a horizontal plane measured from the side wall of the toner container was defined as the collapse angle, and the measurements were performed by 5 times at different positions on the side of the container and the measured values were averaged to determine the collapse angle.

Second Embodiment

In the above-mentioned first embodiment, the protruded portion 22*c* is provided on the side of the bottle 22 opposite to the side having the opening 22*a* so that, when the bottle 22 is lifted upwardly, the protruded portion interferes with the interference portion 25*h* provided on the front wall plate 25*b* of the holding tray 25. In this way, the upward movement of the side of the bottle 22 opposite to the side having the opening is regulated.

Figure 10:
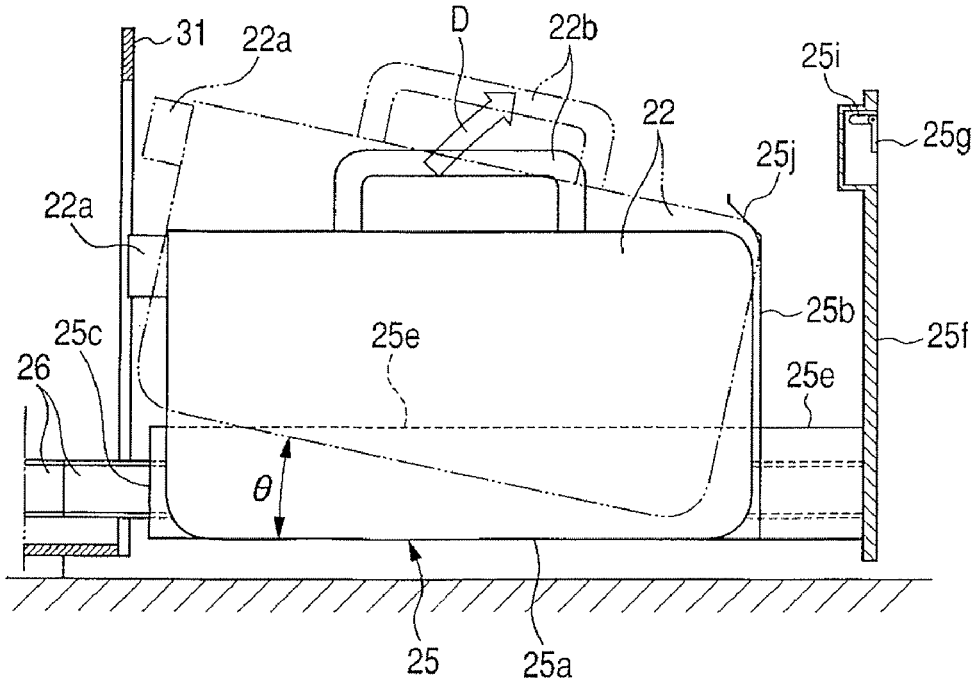
FIG. 10 is a schematic view showing a residual toner collecting portion according to a second embodiment of the present invention.

On the other hand, in a second embodiment of the present invention, as shown in FIG. 10, any protruded portion is not provided on the side of the bottle 22 opposite to the side having the opening 22*a*, but an interference portion 25*j* for preventing the upward movement of the side of the bottle 22 opposite to the side having the opening 22*a* is provided on the front wall plate 25*b* of the tray 25.

Also in the second embodiment, similar to the first embodiment, as shown by the two-dot and chain line, the bottle 22 can be mounted and dismounted with respect to the tray 25 in a condition that the side having the opening 22*a* is inclined upwardly. Further, since the bottle 22 has no protruded portion, the volume efficiency of the bottle can be enhanced and spaces occupied by the bottle and the holding tray can be reduced.

Third Embodiment

Figure 11:
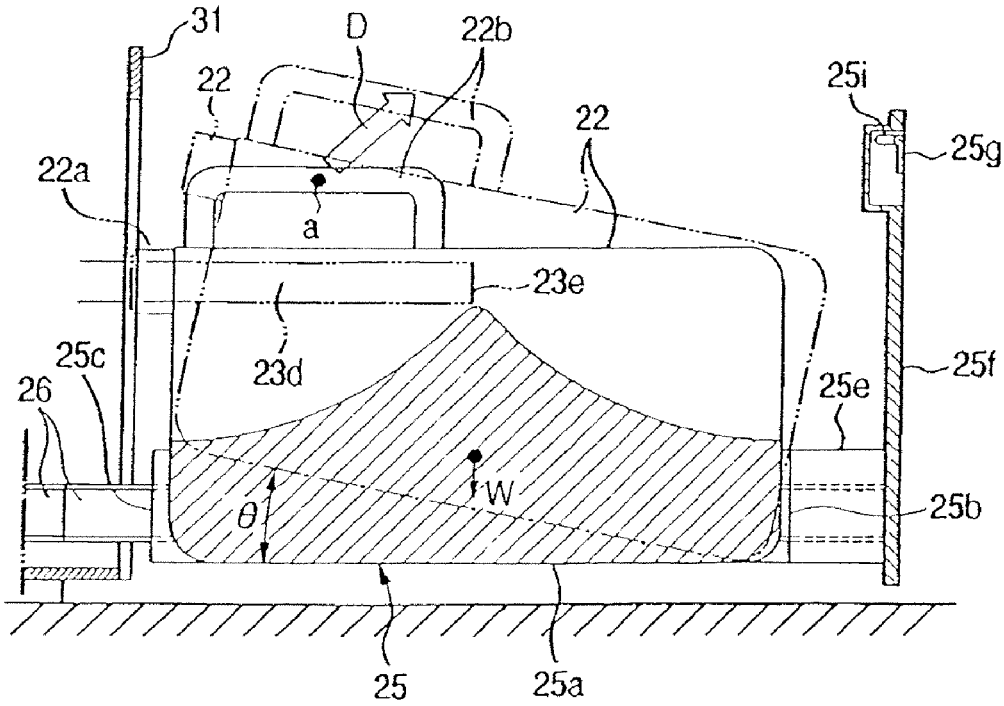
FIG. 11 is a schematic view showing a residual toner collecting portion according to a third embodiment of the present invention.
Figure 12:
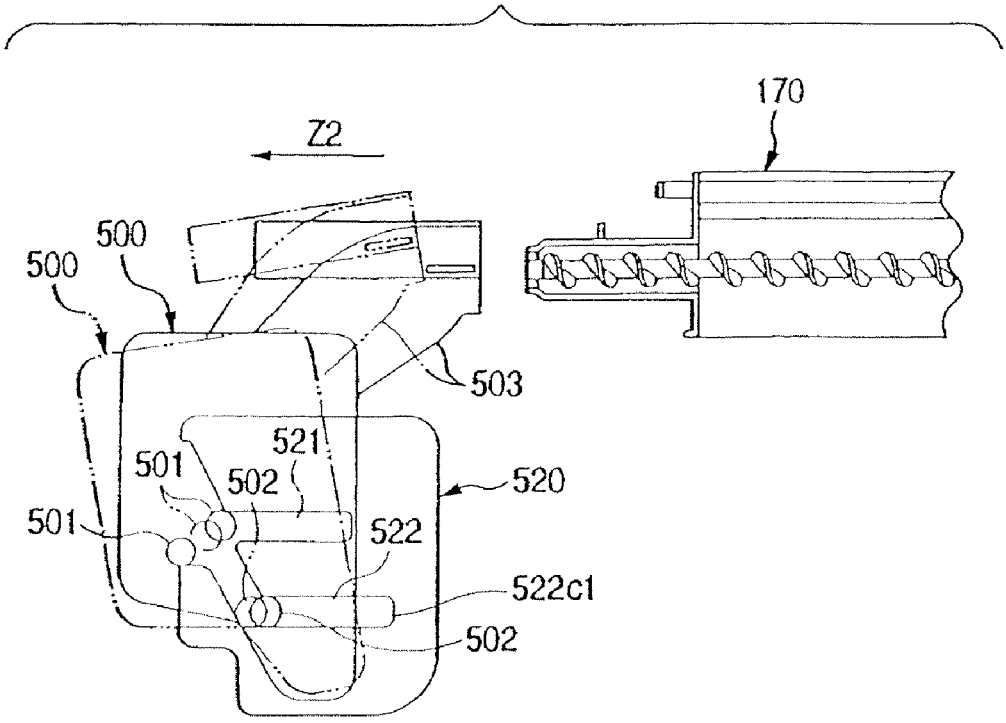
FIG. 12 PRIOR ART
FIG. 12 is an explanatory view for explaining a conventional example.

In a third embodiment of the present invention, as shown in FIG. 11, the grip 22*b* provided on the upper surface of the bottle 22 is positioned at the rear side rather than the central portion. That is to say, a central position a of the grip is located at a position the opening 22*a* in comparison with the toner discharge port 23*e* at the leading end of the third pipe portion 23*d* entered into the bottle 22 in a condition that the bottle 22 is positioned at the predetermined residual toner collecting position within the apparatus body. In FIG. 11, while the regulation member is omitted from illustration, regulation member similar to that of the first embodiment or the second embodiment is provided.

With this arrangement, during the exchanging of the bottle 22 fully filled with the residual toner T, when the bottle 22 is lifted upwardly via the grip 22*b*, as shown by the two-dot and chain line, the bottle 22 takes a posture in which the side having the opening 22*a* is inclined upwardly. That is to say, due to a balancing relationship between the center a of the grip and the center of gravity W of the residual toner T accumulated in the bottle, the side of the bottle 22 opposite to the side having the opening 22*a* is inclined downwardly. Accordingly, the residual toner T in the bottle 22 can be prevented from shifting toward the opening 22*a*. Further, since the residual toner T is shifted toward the direction opposite to the opening 22*a*, even during the transportation of the bottle 22, the condition that the opening 22*a* is directed upwardly is maintained, thereby preventing the residual toner T from flowing out of the opening 22*a*. Further, according to the illustrated embodiment, even after the residual toner collecting contained is dismounted, since the grip is positioned at the side of opening with regard to the center of gravity of the toner collecting container, the opening of the residual toner collecting container can be prevented from directing downwardly. Thus, even after the residual toner collecting container is removed, the toner can be prevented from flowing out of the opening.

The present invention is not limited to the arrangements of the image forming apparatuses shown in the first to third embodiments, and, the holding means for detachably holding the residual toner collecting container may be fixed to the apparatus body. Further, it may be designed so that the residual toner collecting container is mounted and dismounted with respect to the apparatus body by shifting the container laterally of the holding means provided on the apparatus body.

EFFECT OF INVENTION

In the present invention, when the residual toner collecting container is mounted and dismounted, the residual toner collecting container can be removed by inclining the residual toner containing container more than the predetermined angle. Thus, it can be positively prevented that the residual toner collecting container is removed in the condition that the residual toner collecting container is inclined at an angle smaller than the necessary inclined angle, thereby positively preventing the toner from flowing out of the opening of the container. Here, the dismounting or the dismounting operation of the residual toner collecting container means removing or a removing operation of the container from the apparatus body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and function.

This application claims the benefit of Japanese Patent Application No. 2006-172551, filed Jun. 22, 2006, which is hereby incorporated by reference herein in its entirety.

What is claimed is:

1. An image forming apparatus comprising:

an image forming unit for forming a toner image;

a conveying unit for conveying toner discharged from said image forming unit;

a residual toner collecting container that can be detachably mounted to a main body of said image forming apparatus, said residual toner collecting container containing toner conveyed from said conveying unit;

an opening portion provided on a side surface of said residual toner collecting container, said opening portion receiving toner conveyed by said conveying unit;

an interference portion that inclines said residual toner collecting container so as to turn the side surface up by contacting said interference portion with a part of said residual toner collecting container when said residual toner collecting container is lifted up to remove said residual toner collecting container from the main body of said image forming apparatus; and a support unit that supports said residual toner collecting container, wherein said support unit is horizontally drawable with respect to the main body of said image forming apparatus, wherein said conveying unit includes a toner conveyance path, wherein a part of the toner conveyance path extends into said residual toner collecting container through said opening portion when said support unit is positioned inside the main body of said image forming apparatus, and wherein the part of the toner conveyance path that extends into said residual toner collecting container retracts from said residual toner collecting container as said support unit is drawn from the main body of said image forming apparatus.

* * * * *